US010557335B2

(12) United States Patent
Potapenko et al.

(10) Patent No.: US 10,557,335 B2
(45) Date of Patent: Feb. 11, 2020

(54) GAS FRACTURING METHOD AND SYSTEM

(71) Applicant: SCHLUMBERGER TECHNOLOGY CORPORATION, Sugar Land, TX (US)

(72) Inventors: Dmitriy Ivanovich Potapenko, Sugar Land, TX (US); J. Ernest Brown, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/163,366

(22) Filed: Jan. 24, 2014

(65) Prior Publication Data

US 2015/0211343 A1 Jul. 30, 2015

(51) Int. Cl.
*C09K 8/64* (2006.01)
*C09K 8/70* (2006.01)
*E21B 43/16* (2006.01)

(52) U.S. Cl.
CPC ..... *E21B 43/168* (2013.01)

(58) Field of Classification Search
CPC ..... C09K 8/64; C09K 8/703; C09K 8/805; C09K 8/504; E21B 21/003; E21B 43/168
USPC ..... 166/279
See application file for complete search history.

(56) References Cited

U.S. PATENT DOCUMENTS 3,850,247 A 11/1974 Tinsley
4,374,737 A 2/1983 Larson et al.
4,614,604 A 9/1986 Helfert et al.
4,802,998 A 2/1989 Mueller et al.
5,232,910 A 8/1993 Mueller et al.
5,252,554 A 10/1993 Mueller et al.
5,254,531 A 10/1993 Mueller et al.
5,318,954 A 6/1994 Mueller et al.
5,318,956 A 6/1994 Mueller et al.
5,348,938 A 9/1994 Mueller et al.
5,403,822 A 4/1995 Mueller et al.
5,441,927 A 8/1995 Mueller et al.
5,461,028 A 10/1995 Mueller et al.
5,518,996 A 5/1996 Maroy et al.
5,663,122 A 9/1997 Mueller et al.
5,755,892 A 5/1998 Herold et al.
5,846,601 A 12/1998 Ritter et al.
RE36,066 E 1/1999 Mueller et al.
(Continued)

FOREIGN PATENT DOCUMENTS

WO WO2007086771 8/2007
WO WO2011050046 4/2011
(Continued)

OTHER PUBLICATIONS

Potapenko et al., Compositions and Methods for Increasing Fracture Conductivity, U.S. Appl. No. 13/832,938, filed Mar. 15, 2013, pp. 1-30, Not yet published.
(Continued)

*Primary Examiner* — Catherine Loikith
*Assistant Examiner* — Ashish K Varma
(74) *Attorney, Agent, or Firm* — Andrea E. Tran

(57) ABSTRACT

Gas fracturing methods and systems utilizing a gas treatment fluid, which may contain a dispersed phase of fluid loss control agent particles. Also, treatment fluids suitable for use in the methods and systems are disclosed.

19 Claims, 2 Drawing Sheets

(56) References Cited

U.S. PATENT DOCUMENTS

| | | | | |
|---|---|---|---|---|
| 5,869,434 | A | 2/1999 | Mueller et al. | |
| 5,905,468 | A | 5/1999 | Ikawa et al. | |
| 6,022,833 | A | 2/2000 | Mueller et al. | |
| 6,122,860 | A | 9/2000 | Von Tapavicza et al. | |
| 6,165,946 | A | 12/2000 | Mueller et al. | |
| 6,289,989 | B1 | 9/2001 | Mueller et al. | |
| 6,350,788 | B1 | 2/2002 | Herold et al. | |
| 6,599,863 | B1 | 7/2003 | Palmer et al. | |
| 6,716,799 | B1 | 4/2004 | Mueller et al. | |
| 6,776,235 | B1 | 8/2004 | England | |
| 6,806,235 | B1 | 10/2004 | Mueller et al. | |
| 6,820,694 | B2 | 11/2004 | Willberg et al. | |
| 6,828,279 | B2 | 12/2004 | Patel et al. | |
| 7,041,738 | B2 | 5/2006 | Krull et al. | |
| 7,044,220 | B2 | 5/2006 | Nguyen et al. | |
| 7,148,184 | B2 * | 12/2006 | Francini | C09K 8/72 507/241 |
| 7,275,596 | B2 | 10/2007 | Willberg et al. | |
| 7,281,581 | B2 | 10/2007 | Nguyen et al. | |
| 7,325,608 | B2 | 2/2008 | van Batenburg et al. | |
| 7,380,601 | B2 | 6/2008 | Willberg et al. | |
| 7,665,522 | B2 | 2/2010 | Sullivan et al. | |
| 7,666,820 | B2 | 2/2010 | Mueller et al. | |
| 7,741,248 | B2 | 6/2010 | Mueller et al. | |
| 7,784,541 | B2 | 8/2010 | Hartman et al. | |
| 7,789,146 | B2 | 9/2010 | Panga et al. | |
| 7,798,224 | B2 | 9/2010 | Huang et al. | |
| 7,833,950 | B2 | 11/2010 | Willberg et al. | |
| 7,931,089 | B2 | 4/2011 | Miller et al. | |
| 7,998,909 | B2 * | 8/2011 | Lin | C09K 8/536 166/308.1 |
| 8,008,234 | B2 | 8/2011 | Panga et al. | |
| 8,042,614 | B2 | 10/2011 | Sullivan et al. | |
| 8,119,574 | B2 | 2/2012 | Panga et al. | |
| 8,210,249 | B2 | 7/2012 | Panga et al. | |
| 8,227,026 | B2 | 7/2012 | McDaniel et al. | |
| 8,230,925 | B2 | 7/2012 | Willberg et al. | |
| 8,234,072 | B2 | 7/2012 | Smith, Jr. et al. | |
| 8,236,735 | B2 | 8/2012 | Maker et al. | |
| 8,372,787 | B2 | 2/2013 | Droger | |
| 2008/0135242 | A1 | 6/2008 | Lesko et al. | |
| 2008/0196896 | A1 | 8/2008 | Bustos et al. | |
| 2009/0025934 | A1 | 1/2009 | Hartman et al. | |
| 2010/0300688 | A1 | 12/2010 | Panga et al. | |
| 2011/0098202 | A1 | 4/2011 | James et al. | |
| 2012/0000641 | A1 | 1/2012 | Panga et al. | |
| 2012/0111563 | A1 | 5/2012 | Abad et al. | |
| 2012/0132421 | A1 * | 5/2012 | Loiseau et al. | 166/279 |
| 2012/0138296 | A1 | 6/2012 | Panga et al. | |
| 2012/0305245 | A1 | 12/2012 | Loiseau et al. | |
| 2012/0305254 | A1 | 12/2012 | Chen et al. | |
| 2014/0076570 | A1 * | 3/2014 | Nguyen | E21B 33/138 166/307 |
| 2015/0211346 | A1 * | 7/2015 | Potapenko | E21B 43/26 166/280.2 |

FOREIGN PATENT DOCUMENTS

| | | |
|---|---|---|
| WO | WO2012054456 | 4/2012 |
| WO | WO2013085412 | 6/2013 |

OTHER PUBLICATIONS

Potapenko et al., In Situ Channelization Method and System for Increasing Fracture Conductivity, U.S. Appl. No. 13/974,203, filed Aug. 23, 2013, pp. 1-50, Not yet published.

Potapenko et al., Well Treatment, U.S. Appl. No. 61/873,185, filed Sep. 3, 2013, pp. 1-23.

Panga et al., Well Treatment With Shapeshifting Particles, U.S. Appl. No. 14/056,665, filed Oct. 17, 2013, pp. 1-56, Not yet published.

Coursen, D.L., Early Production From Some Devonian Shale Gas Wells Stimulated With Several Kinds of Explosive Charge, SPE 12322, Eastern Regional Meeting, Nov. 9-11, 1983, pp. 217-221 plus 3 sheets of drawings and 1 sheet of blueprint, Society of Petroleum Engineers of AIME.

Cuderman et al., A Propellant-Based Technology for Multiple-Fracturing Wellbores to Enhance Gas Recovery: Application and Results in Devonian Shale, SPE 12838, 1984 SPE/DOE/GRI Unconventional Gas Recovery Symposium, May 13-15, 1984, published in SPE Production Engineering, Mar. 1986, pp. 97-103, Society of Petroleum Engineers.

Friend, et al., Completion Methods and Results Comparison of Devonian Shale in the Big Sandy Field, SPE 30989, Eastern Regional Meeting, Sep. 17-21, 1995, pp. 111-116, Society of Petroleum Engineers, Inc.

Hamilton, et al., Reliable Method of Achieving Annular Isolation for a Multi-Stage Fracture Treatment in an Air Drilled Hole, SPE 125866, 2009 SPE Eastern Regional Meeting, Sep. 23-25, 2009, pp. 1-7, Society of Petroleum Engineers.

Komar, C.A., Development of a Rationale for Stimulation Design in the Devonian Shale, SPE 7166, 1978 Regional Gas Technology Symposium of the Society of Petroleum Engineers of AIME, Jun. 7-9, 1978, pp. 1-14, American Institute of Mining, Metallurgical, and Petroleum Engineers, Inc.

Lancaster, et al., A Case Study of the Evaluation, Completion, and Testing of a Devonian Shale Gas Well, SPE 17037, 1987 SPE Eastern Regional Meeting, Oct. 21-23, 1987, published in Journal of Petroleum Technology, May 1989, pp. 509-518, Society of Petroleum Engineers.

MacDonald, et al., Comparing Production Response from Devonian Shale and Berea Wells Stimulated with Nitrogen Foam and Proppant vs. Nitrogen-Only, Pike Co., Kentucky, SPE 77464, SPE Annual Technical Conference and Exhibition Sep. 29-Oct. 2, 2002, pp. 1-7, Society of Petroleum Engineers, Inc.

MacDonald, et al., An Update of Recent Production Responses Obtained from Devonian Shale and Berea Wells Stimulated with Nitrogen Foam (with Proppant) vs. Nitrogen-Only, Pike Co., KY, SPE 84834, SPE Eastern Regional/AAPG Eastern Section Joint Meeting, Sep. 6-10, 2003, pp. 1-5, Society of Petroleum Engineers, Inc.

Shaw et al., Reservoir and Stimulation Analysis of a Devonian Shale Gas Field, SPE 15938, 1986 SPE Eastern Regional Meeting, Nov. 12-14, 1986, published in SPE Production Engineering, Nov. 1989, pp. 450-458, Society of Petroleum Engineers.

Stidham et al., Nitrogen Coiled-Tubing Fracturing in the Appalachian Basin, SPE 72382, SPE Eastern Regional Meeting, Oct. 17-19, 2001, pp. 1-5, Society of Petroleum Engineers, Inc.

Strang, et al., Foamed Sand Provides Improved Stimulation Results from Devonian Shale, SPE 12312, Eastern Regional Meeting, Nov. 9-11, pp. 137-142, Society of Petroleum Engineers of AIME.

Wozniak, et al., Completion Optimization in the Lower Huron Shale in Kentucky, SPE 138254, SPE Eastern Regional Meeting Oct. 12-14, 2010, pp. 1-16, Society of Petroleum Engineers.

Yost, et al., Hydraulic Fracturing of a Horizontal Well in a Naturally Fractured Reservoir: Gas Study for Multiple Fracture Design, SPE 17759, SPE Gas Technology Symposium, Jun. 13-15, 1988, pp. 451-460.

Yost, et al., Production and Stimulation Analysis of Multiple Hydraulic Fracturing of a 2,000-ft Horizontal Well, SPE 19090, SPE Gas Technology Symposium, Jun. 7-9, 1989, pp. 1-14.

Yost, et al., CO2/Sand Fracturing in Devonian Shales, SPE 26925, 1993 Eastern Regional Conference & Exhibition, Nov. 2-4, 1993, pp. 353-362.

Yost, et al., Analysis of Production Response to CO2/Sand Fracturing: A Case Study, SPE 29191, 1994 Eastern Regional Conference & Exhibition, Nov. 8-10, 1994, pp. 297-303.

* cited by examiner

GAS FRACTURING METHOD AND SYSTEM

BACKGROUND

The statements in this section merely provide background information related to the present disclosure and may not constitute prior art.

Gas fracturing, either with compressed gas alone or in a hybridized version with proppant, has been used to create conductive pathways in a subterranean formation and increase fluid flow between the formation and the wellbore. The gas is injected into the wellbore passing through the subterranean formation at very high rates to offset high leakoff into the formation being treated. Even without proppant, the fractures created may have sufficient conductivity due to their length and dendricity to enable production of reservoir fluids comparable to fractures in the same formation conventionally filled with proppant. Accordingly, there is a demand for further improvements in this area of technology.

SUMMARY

In some embodiments according to the disclosure herein, a mist phase is used in methods and systems to deposit liquid, foam, fine particles or other fluid loss control agent on the exposed surface of a permeable structure to inhibit fluid loss from a high pressure gas phase through the structure, e.g., in gas fracturing methods and systems to deposit the fluid loss control agent on the exposed fracture faces to inhibit the otherwise high rate of fluid loss from the gas phase into the formation matrix.

In some embodiments, a method for treating a subterranean formation penetrated by a wellbore may comprise injecting above a fracturing pressure into a fracture in the formation a gas treatment fluid stage substantially free of proppant and comprising a continuous gas phase and a mist phase comprising a liquid or foam dispersed in the continuous gas phase; depositing some of the mist phase such as particles [liquid/foam/solid] from the mist phase onto a surface of the formation to inhibit fluid loss into a matrix of the formation; and reducing the pressure in the fracture to form a network of conductive gas-fractured flow paths in the formation.

In some embodiments, a gas fracturing system may comprise a treatment fluid supply unit to supply a treatment fluid stage comprising a continuous gas phase at a pressure above fracturing pressure to form a fracture in a formation; a mist phase comprising particles of liquid, foam, fine solids or a combination thereof dispersed in the gas phase in an amount of from 0.5 to 10 volume percent based on the total volume of the gas and mist phases; and a fluid loss control system present in the mist phase in an amount to inhibit fluid loss into the formation.

BRIEF DESCRIPTION OF THE DRAWINGS

These and other features and advantages will be better understood by reference to the following detailed description when considered in conjunction with the accompanying drawings.

DETAILED DESCRIPTION

Figure 1:
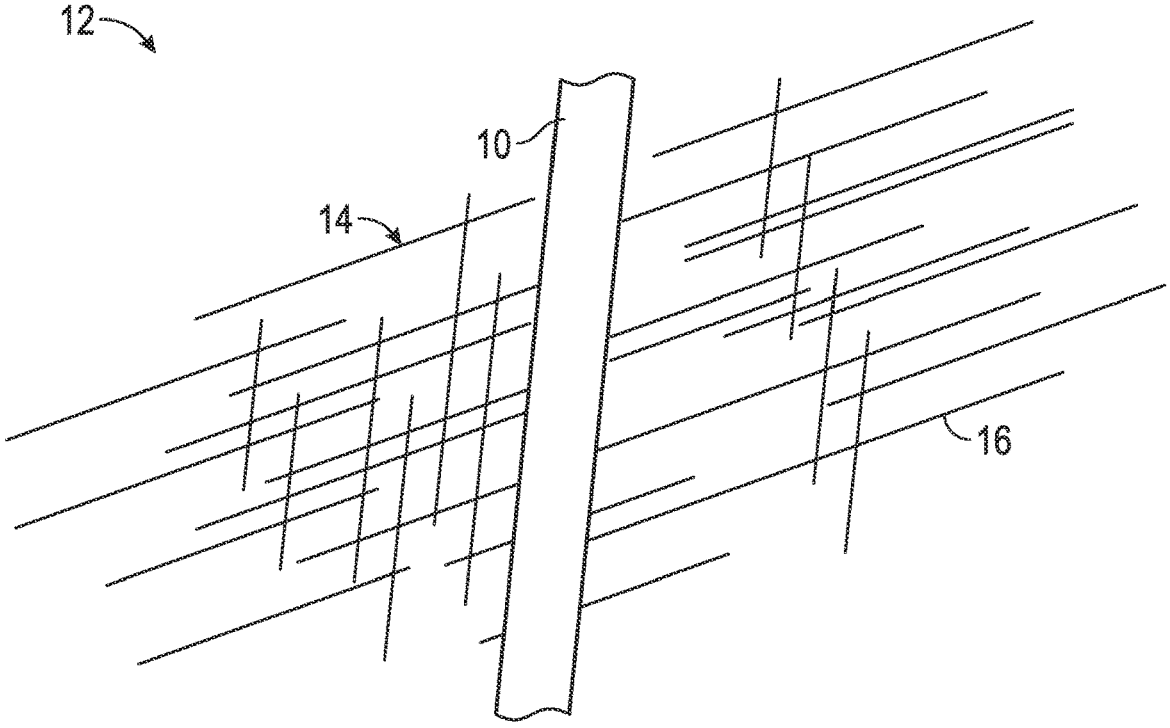
FIG. 1 schematically illustrates a fracture system with a branched tip region formed by early-stage gas fracturing according to embodiments.

For the purposes of promoting an understanding of the principles of the disclosure, reference will now be made to some illustrative embodiments of the current application. Like reference numerals used herein refer to like parts in the various drawings. Reference numerals without suffixed letters refer to the part(s) in general; reference numerals with suffixed letters refer to a specific one of the parts.

As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

It should be understood that, although a substantial portion of the following detailed description may be provided in the context of oilfield fracturing operations, other oilfield operations such as cementing, gravel packing, etc., or even non-oilfield well treatment operations, can utilize and benefit as well from the instant disclosure.

In some embodiments according to the disclosure herein, gas fracturing methods and systems may employ a mist phase to deposit a fluid loss control agent on the exposed fracture faces to inhibit fluid loss from the gas treatment fluid stage for improved fracture efficiency. A "fluid loss control agent," sometimes referred to herein as a "fluid loss agent" or "loss agent," refers to a material in the fluid that can inhibit loss of the fluid through contact with a permeable structure to a region of lower pressure.

In some embodiments of the method, treating a subterranean formation penetrated by a wellbore comprises injecting, above a fracturing pressure into a fracture in the formation, a gas treatment fluid stage substantially free of proppant and comprising a continuous gas phase and a mist phase comprising a liquid or foam dispersed in the continuous gas phase; depositing particles from the mist phase onto a surface of the formation to inhibit fluid loss into a matrix of the formation; and reducing the pressure in the fracture to form a network of conductive paths in the formation. In some embodiments, these paths may comprise gas-fractured flow paths.

In some embodiments of the gas fracturing system, the system comprises a treatment fluid supply unit to supply a treatment fluid stage comprising a continuous gas phase at a pressure above fracturing pressure to a formation to form a fracture in the formation; a mist phase comprising particles of liquid, foam, fine solids or a combination thereof dispersed in the gas phase in an amount of from 0.5 to 10 volume percent, e.g., up to 5 volume percent, based on the total volume of the gas and mist phases; and a fluid loss control system, which may be comprised wholly or in part of the particles of liquid, foam, fine solids, present in the mist phase in an amount to inhibit fluid loss into the formation.

The gas phase in various embodiments may comprise any material or mixture of materials that is a gas at any or all downhole or formation temperature(s) and pressure(s) used during the gas fracturing, including a supercritical fluid. As used herein, supercritical refers to a fluid above both its critical temperature and its critical pressure, whereas subcritical refers to a fluid which is below its critical temperature, or below its critical pressure, or both. Gases, including supercritical fluids, may have a viscosity at the fracturing conditions equal to or less than about 100 μPa·s. Representative gases for the continuous gas phase include nitrogen, air, carbon dioxide, methane, ethane, and the like.

In some embodiments, the continuous gas phase comprises a supercritical fluid, e.g., a supercritical fluid having a viscosity in the range of 10 to 100 μPa·s. In some embodiments, the use of a supercritical fluid as the gas phase inhibits gas leakoff since supercritical fluids generally have a higher viscosity than their non-supercritical counterpart gases and hence a lower permeation rate into the formation matrix.

In some embodiments, the gas phase is a subcritical fluid, and in some further embodiments the use of a subcritical gas phase, e.g., with a generally lower viscosity less than about 10 μPa·s and thus having a tendency for a higher leakoff rate which might make them otherwise impractical for use in gas fracturing, is facilitated by the presence of the leakoff inhibition obtained by the presence of the mist phase.

The mist phase in various embodiments may be any particles (including fluid or foam droplets) that are suspended or otherwise dispersed as a discontinuous phase in the continuous gas phase in a disjointed manner, e.g., colloidal particles in an aerosol or larger particles in a gas suspension. The term "dispersion" means a mixture of one substance dispersed in another substance, and may include colloidal or non-colloidal systems. In this respect, the mist phase can also be referred to, collectively, as "particle" or "particulate" which terms may be used interchangeably. As used herein, the term "particle" should be construed broadly. For example, in some embodiments, the particles of the current application are fine solids, defined for the purposes herein as having a particle size less than 10 microns, e.g., 1 to 10 μm, or ultrafine solids or colloids, defined for the purposes herein as fine particles having a particle size less than 1 micron, e.g., 1 to 1000 nm; however, in some other embodiments, the particle(s) can be liquid, foam, emulsified droplets, fine or ultrafine solids coated by or suspended in liquid or foam, etc. The particles comprising the mist phase may have a particle size distribution that is either monodisperse or polydisperse, e.g., bimodal, trimodal, tetramodal, or the like. Liquid and/or foam particles whether containing solids or not, are almost always spherical or nearly spherical, but may be irregular; whereas solid particles may be spherical or irregular, e.g., with varying degrees of sphericity and roundness, according to the API RP-60 sphericity and roundness index. For example, the particle(s) used as fluid loss agents in the mist phase may have an aspect ratio of more than 2, 3, 4, 5 or 6. Examples of such non-spherical particles include, but are not limited to, fibers, flocs, flakes, discs, rods, grains, stars, etc. All such variations should be considered within the scope of the current application.

As used herein, "substantially free of proppant" refers to a gas treatment fluid stage to which proppant or other solid particles having a particle size of 100 microns or more is not present, or if present, is present in amounts of less than 0.5 volume percent, or has not been deliberately added in amounts of more than 0.5 volume percent, by total volume of the gas treatment fluid stage, or comprises less than 10 volume percent by volume of the mist phase.

In some embodiments herein, fluid loss control to inhibit loss of the gas phase is effected by plugging at least a portion of micropores in the formation matrix with a fluid loss control agent such as fine solids, which results in a decrease in permeability and thus a reduction of the gas penetration rate into the formation. In some embodiments, at least a portion of the micropores may be alternatively or additionally filled with a fluid such as liquid, foam, or the like which has a higher viscosity relative to the gas phase, which also contributes to a decreased fluid penetration rate.

According to some embodiments, liquid, foam and/or solid fluid loss agents may be delivered in a form of a mist or vapor, and deposited on the fracture face, followed by penetration into the pore spaces. In some embodiments, a foam, which generally has a much higher viscosity than its liquid phase per se, may be used to fill micropores to enhance loss control. In some embodiments, an energized liquid may be used to fill micropores, and may thereafter form a foam in situ upon expansion from the fracturing pressure to the formation pressure. Such fluid loss agents in various embodiments may also comprise several components, such as, for example, clay stabilizing agent(s), surfactant(s), foaming agent(s), corrosion inhibitor(s), gelling agent(s), delayed crosslinking agent(s), pH agent(s), breaker(s), etc., including combinations thereof.

According to some embodiments, the mist phase particles comprise a size of less than 100 microns, e.g., less than 50 microns, less than 20 microns, less than 10 microns or less than 1 micron. According to some embodiments, the particles comprise monophasic liquid, emulsion, foam, solids or a combination thereof. According to some embodiments, the mist phase is aqueous, such as, for example, comprised of water, brine, acid solutions, alkali solutions, or the like. According to some embodiments, the mist phase comprises a hydrophobic phase such as a hydrocarbon, e.g., a subcritical hydrocarbon liquid. As used herein, subcritical refers to a material which is below its critical temperature, or below its critical pressure, or both. In some embodiments, the mist phase comprises a mixture of water based liquids and organic liquids, including emulsions. As used herein, "emulsion" generally means any system with one liquid phase dispersed in another immiscible liquid phase, and may apply to oil-in-water and water-in-oil emulsions, including oil-in-water-in-oil and water-in-oil-in-water emulsions. Invert or reverse emulsions refer to any water-in-oil emulsion in which oil is the continuous or external phase and water is the dispersed or internal phase.

According to some embodiments, the mist phase comprises a hydrolyzable compound. According to some embodiments, the mist phase comprises a degradable oil. In embodiments, the degradable oil is any degradable oleaginous fluid such as, for example, an oleophilic ester, ether, amide, amine, alcohol, glycoside, or combination thereof, and may have a solubility in water of less than 10 weight percent, or less than 5 weight percent, or less than 1 weight percent at 25° C. In embodiments, the degradable oil may be selected from the group consisting of oleophilic monocarboxylic acid esters comprising from 3 to 40 carbon atoms, oleophilic polycarboxylic acid esters comprising from 4 to 40 carbon atoms, oleophilic ethers comprising from 3 to 40 carbon atoms, oleophilic alcohols comprising from 3 to 40 carbon atoms, and combinations thereof. In some embodiments, the degradable oil is non-toxicological.

For purposes herein, a material having solubility in water of less than 10 weight percent, or less than 5 weight percent, or less than 1 weight percent at 25° C. is said to be oleophilic. In some embodiments, the degradable oil may comprise two or more moieties attached via a functional group, e.g., a carboxylic acid, an alcohol, an amine, an amide, a glycoside, an ether, in which the chain length of one of the moieties is from 1 to 40, or from 6 to 30, or from 8 to 15 carbon atoms, with the remaining carbon atoms, or hydrogen atom(s) in the case of an alcohol or an amine, forming the other moiety or moieties. In some embodiments, the degradable oil undergoes hydrolysis upon contact with an aqueous solution having a pH from about 9 to 14 and/or a pH from about 0 to 5. In some embodiments, the degradable oil has a hydrophilic-lipophilic balance of less than 16, or less than 14, or less than 12, or less than 10, as determined according to Griffin's method on a scale from 0 to 20 as is readily understood by one having minimal skill in the art.

In embodiments, the degradable oil is converted from a relatively water insoluble oil into its water soluble components upon exposure to temperature, biological agents, acids, bases, and/or the like present at, or provided to the intended location of the fluid for a particular use, e.g., upon or after fracture closure or otherwise after the degradable oil has been used as a fluid loss agent during the gas fracturing operation. In some embodiments, the degradable oil undergoes hydrolysis at a pH from about 0 to 14, or at a pH of greater than or equal to about 9, e.g., from about 9 to 14 or higher, and/or at a pH of less than or equal to about 4, e.g., from about 4 to about 0 or less.

In some embodiments, the degradable oil comprises a monocarboxylic acid ester having ecologically acceptable components from the class of so-called non-polluting oils. Examples include esters of "lower" carboxylic acids having from 1 to 10 carbons. Suitable lower monocarboxylic acids include the reaction products of monofunctional alcohols, polyfunctional alcohols, and the like. Suitable alcohols include di- to tetra-hydric alcohols, lower alcohols of this type, including having 2 to 6 carbon atoms. Examples of such poly-hydric alcohols include aliphatic glycols and/or propanediols such as ethylene glycol, 1,2-propanediol and/or 1,3-propanediol. Suitable alcohols can be of natural and/or synthetic origin. Straight-chain and/or branched alcohols may be used herein.

In some embodiments, the ester oils may be the reaction product of long-chain acids having from 11 to 40 carbon atoms, which may include unsaturated and/or polyunsaturated acids. The carboxylic acid radicals present can be of vegetable and/or animal origin. Vegetable starting materials include, for example, palm oil, peanut oil, castor oil and/or rapeseed oil. The carboxylic acids of animal origin include tallow, fish oils, rendering oils, and the like. Other suitable degradable oils include anchovy oil, castor oil, palm oil, virgin coconut oil, salmon oil, sunflower oil, soy bean oil, cod liver oil, oil, $C_{10-28}$ fatty acid $C_{1-10}$ alkyl esters (e.g., fatty acid methyl esters), and the like.

In some embodiments, the ester-containing degradable oil may be contacted with dilute alkali to produce a salt and an alcohol. The formation of alcohol reduces the surface tension and alters wettability. In the case of an emulsion with water as a continuous phase and the ester based oil as the dispersed phase, the hydrolysis of the oil will reduce the surface tension of the continuous water phase and enhance wettability, which may likewise enhance the flowback and cleanup in some embodiments.

In some embodiments, the degradable oleaginous oil may include an ester, which, when contacted with an acid will hydrolyze to produce an acid and an alcohol, which may reduce the surface tension and enhance the wettability of the formation.

In some embodiments, the degradable oil is non-toxicological, meaning it does not degrade into toxic substances, or substances which have an acute toxicity such that they would be considered hazardous or toxic in the intended environment. In some embodiments, the degradable oil comprises less than about 1 weight percent aromatic content, or less than about 0.5 weight percent aromatic content, or less than 0.1 weight percent aromatic content.

In some embodiments, the degradable oil comprises a linear alpha olefin, which may be of natural or synthetic origin.

In some embodiments, the degradable oil may comprise various substituted and/or fully esterified triglycerides.

In some embodiments, the degradable oil may comprise $C_2$-$C_{12}$ alkoxylates, e.g., ethoxylates, propoxylates, and/or the like, including alkoxylated alcohols, acids, polyethers, amines, amides, glycosides, and/or the like.

Suitable degradable oils include FlexiSOLV® dibutyl ester (DBE) (INVISTA, Koch Industries, USA), which are high boiling oxygenated solvents that are miscible with organic solvents, low odor and flammability, comprising refined dimethyl esters of adipic, glutaric and succinic acids. The DBE esters undergo reactions expected of the ester group such as hydrolysis and transesterification. At low and high pH the DBE esters are hydrolyzed to the corresponding acids, their salts and alcohol. The dibutyl ester components of dimethyl succinate, dimethyl glutarate and dimethyl adipate are readily biodegradable.

Suitable examples further include AMSOIL biodegradable oil (AMSOIL INC., USA) which is designed to biodegrade when subjected to sunlight, water and microbial activity. The biodegradable oil is a blend of oleic vegetable oils and customized synthetic esters. AMSOIL® oil exhibits high biodegradability and low aquatic toxicity, along with superior oxidative stability, and low temperature performance. It contains anti-oxidants that ensure long oil life and foam inhibitors that promote problem-free operation. It is hydrolytically stable and ideal for use where water contamination is a problem.

Other suitable degradable oils include those disclosed in U.S. Pat. Nos. 4,374,737; 4,614,604; 4,802,998; 5,232,910; 5,252,554; 5,254,531; 5,318,954; 5,318,956; 5,348,938; 5,403,822; 5,441,927; 5,461,028; 5,663,122; 5,755,892; 5,846,601; RE 36,066; U.S. Pat. Nos. 5,869,434; 6,022,833; 6,122,860; 6,165,946; 6,289,989; 6,350,788; 6,716,799; 6,806,235; 6,828,279; 7,041,738; 7,666,820; 7,741,248; and 8,236,735; all of which are hereby incorporated by reference.

According to some embodiments, the mist phase comprises a material selected from the group consisting of esters, polyamines, polyethers and combinations thereof. According to some embodiments, the method further comprises degrading the mist particles deposited on the formation surface to facilitate conductivity.

According to some embodiments, the mist phase comprises a foaming agent and/or may be a foam. The term "foam" refers to a stable mixture of gas(es) and liquid(s) that form a two-phase system. Foam is generally described by its foam quality, i.e. the ratio of gas volume to the foam volume (fluid phase of the treatment fluid), i.e., the ratio of the gas volume to the sum of the gas plus liquid volumes). If the foam quality is between 52% and 95%, the fluid is usually called foam. Below 52%, the foam may be referred to as an "energized fluid." Above 95%, foam is generally changed to mist, i.e., dispersed liquid or foam droplets in a continuous gas phase. In the present patent application, the term "foam" also encompasses two-phase energized liquids and refers to any stable mixture of gas and liquid, regardless of the foam quality.

According to some embodiments, the mist phase comprises fine solids less than 10 microns, or ultrafine solids less than 1 micron, or 30 nm to 1 micron. According to some embodiments, the fine solids are fluid loss control agents such as γ-alumina, colloidal silica, CaCO3, SiO2, bentonite etc.; and may comprise particulates with different shapes such as glass fibers, flocs, flakes, films; and any combination thereof or the like. Colloidal silica, for example, may function as an ultrafine solid loss control agent, depending on the size of the micropores in the formation, as well as a gellant and/or thickener in any associated liquid or foam phase. As representative leakoff control agents, there may be mentioned latex dispersions, water soluble polymers, submicron particulates, particulates with an aspect ratio higher than 1, or higher than 6, combinations thereof and the like, such as, for example, crosslinked polyvinyl alcohol microgel. The fluid loss agent can be, for example, a latex dispersion of polyvinylidene chloride, polyvinyl acetate, polystyrene-co-butadiene; a water soluble polymer such as hydroxyethylcellulose (HEC), guar, copolymers of polyacrylamide and their derivatives; particulate fluid loss control agents in the size range of 30 nm to 1 micron, such as γ-alumina, colloidal silica, $CaCO_3$, $SiO_2$, bentonite etc.; particulates with different shapes such as glass fibers, flakes, films; and any combination thereof or the like. Fluid loss agents can if desired also include or be used in combination with acrylamido-methyl-propane sulfonate polymer (AMPS).

In embodiments, the leak-off control agent comprises a fine or ultrafine solid that may removable by degradation, dissolution, melting, or the like. In some embodiments, the fluid loss agent may be a reactive solid, e.g., a hydrolysable material such as polyglycolic acid (PGA), polylactic acid (PLA), PGA-PLA copolymers, or the like; or it can include a soluble or solubilizable material such as a wax, an oil-soluble resin, or another material soluble in hydrocarbons, or calcium carbonate or another material soluble at low pH; and so on. In embodiments, the leak-off control agent comprises a reactive solid selected from ground quartz, oil soluble resin, degradable rock salt, clay, zeolite or the like. In other embodiments, the leak-off control agent comprises one or more of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass, or the like.

According to some embodiments, the mist phase comprises from 0.5 to 10 weight percent by volume, or less than 5 weight percent by volume of the gas treatment fluid stage, based on the total volume of the gas treatment fluid stage, as determined at the bottom hole pressure and temperature where it enters the fracture.

According to some embodiments, the gas treatment fluid stage is injected as a pad or pre-pad stage and the method further comprises: injecting one or more proppant stages into the fracture following the gas treatment fluid stage prior to fracture closure.

According to some embodiments, a hybrid method for treating a subterranean formation penetrated by a wellbore comprises injecting a substantially proppant-free early stage comprising a continuous gas phase (and optionally a mist phase as described above) into the formation above a fracturing pressure to form a fracture system comprising a branched tip region, and injecting one or more proppant stages, comprising a treatment fluid comprising proppant and having a viscosity greater than the early stage, into the formation behind the early stage to form a propped region of the fracture system to communicate between the wellbore and the branched tip region. According to some embodiments, the early stage comprises particles dispersed in the continuous gas phase as a fluid loss control agent, as described above, e.g., particles dispersed in the continuous gas phase comprising fines having a diameter of less than 50 microns and are substantially free of solids having a diameter greater than 100 microns.

According to some embodiments of the hybrid method, the one or more proppant stages comprise slickwater and a proppant loading from 0.01 to 0.6 g/mL of carrier fluid (0.1-5 ppa).

According to some embodiments of the hybrid method, the one or more proppant stages comprise an aqueous or oil-based carrier fluid, a viscosifier and a proppant loading of at least 0.6 g/mL of carrier fluid (5 ppa).

According to some embodiments of the hybrid method, the one or more proppant stages comprise a high solid content fluid, e.g., a slurry wherein a sum of all the particulates in the fracturing slurry is greater than about 16 pounds per gallon of the carrier fluid, or is greater than about 23 pounds per gallon of the carrier fluid, or is greater than 30 pounds per gallon of the carrier fluid, as disclosed in U.S. Pat. No. 7,784,541, herewith incorporated by reference in its entirety.

According to some embodiments of the hybrid method, the one or more proppant stages comprise alternating proppant concentration between successive proppant stages and/or alternating stages of proppant-containing hydraulic fracturing fluids contrasting in their proppant-settling rates to form proppant clusters which become pillars that prevent the fracture from completely closing, as described in U.S. Pat. No. 6,776,235, herewith incorporated by reference in its entirety.

According to some embodiments of the hybrid method, the method may further comprise injecting one or more substantially proppant-free stages between successive ones of the proppant stages, as described in Patent Publication U.S. 2008/0135242, herewith incorporated by reference in its entirety.

According to some embodiments of the hybrid method, the one or more proppant stages comprise carrier fluid, proppant and agglomerant, wherein injection of the one or more proppant stages forms a substantially uniformly distributed mixture of the proppant and the agglomerant, and wherein the proppant and the agglomerant have dissimilar velocities in the fracture system to transform the substantially uniformly distributed mixture into areas that are rich in proppant and areas that are substantially free of proppant, as described in U.S. application Ser. No. 13/832,938, filed Mar. 15, 2013, herewith incorporated herein by reference in its entirety.

According to some embodiments of the hybrid method, the one or more proppant stages comprise proppant and shapeshifting particles dispersed in a carrier fluid, and further comprising changing a conformation of the shapeshifting particles in the fracture system, as described in U.S. application Ser. No. 14/056,665, filed Oct. 17, 2013 herewith incorporated herein by reference in its entirety.

According to some embodiments of the hybrid method, the method may further comprise: continuously distributing the proppant into the fracture system during the injection of the one or more proppant stages; aggregating the proppant distributed into the fracture to form spaced-apart clusters in the fracture system; anchoring at least some of the clusters in the fracture system to inhibit aggregation of at least some of the clusters; and reducing pressure in the fracture system to form interconnected, hydraulically conductive channels between the clusters in the propped region of the fracture system, as described in U.S. application Ser. No. 13/974,203, filed Aug. 23, 2013, herewith incorporated herein by reference in its entirety.

According to some embodiments of the hybrid method, the method may further comprise: injecting the one or more proppant stages at a continuous rate with a continuous proppant concentration; while maintaining the continuous rate and proppant concentration, successively alternating concentration modes of an anchorant in the one or more proppant stages between a plurality of relatively anchorant-rich modes and a plurality of anchorant-lean modes, as also described in U.S. application Ser. No. 13/974,203, filed Aug. 23, 2013, herewith incorporated herein by reference in its entirety.

According to some embodiments of the hybrid method, the method may further comprise: providing a treatment slurry comprising an energized fluid, the proppant and an anchorant, injecting the treatment slurry into a fracture to form a substantially uniformly distributed mixture of the solid particulate and the anchorant, and transforming the substantially uniform mixture into areas that are rich in solid particulate and areas that are substantially free of solid particulate, as described in U.S. provisional Application Ser. No. 61/873,185, filed Sep. 3, 2013, herewith incorporated herein by reference in its entirety.

According to some embodiments of the hybrid method, the proppant stage(s) may be injected into the fracture system using any one of the available heterogeneous proppant placement techniques, such as, for example, those disclosed in U.S. Pat. Nos. 3,850,247; 7,281,581; 7,325,608; 7,044,220; WO 2007/086771; each of which is hereby incorporated herein by reference in its entirety.

According to some embodiments of the hybrid method, the early stage is injected as a pre-pad stage and the method further comprises injecting a foam or liquid pad stage into the fracture system following the pre-pad stage prior to the one or more proppant stages. According to some embodiments of the hybrid method, the method may further comprise injecting a flush stage into the fracture system following the one or more proppant stages.

According to some embodiments, a reservoir fluid production system comprises a wellbore penetrating a subterranean formation; and the fracture system obtained by the hybrid method described herein in fluid communication with the wellbore. According to some embodiments, the branched tip region of the fracture system is substantially proppant-free.

According to some embodiments, a system to treat a subterranean formation, comprises: a subterranean formation penetrated by a wellbore; a gas injection unit to supply a gas treatment fluid stage, substantially free of proppant and comprising a continuous gas phase, to the formation above a fracturing pressure to form a fracture system comprising a branched tip region; and a pump system to supply one or more proppant stages, comprising a treatment fluid comprising proppant and having a viscosity greater than the gas treatment fluid stage, into the fracture system behind the gas treatment fluid stage to form a propped region of the fracture system to communicate between the wellbore and the branched tip region.

With reference to FIG. 1, an initial gas fracturing stage involves injecting the gas comprising the mist phase described herein through the wellbore 10 into the formation 12 to form a fracture system 14 having a relatively branched, dendritic tip region 16 extending away from the wellbore. The fracture system 14 as illustrated may represent either a generally horizontal wellbore 10 shown in plan, or a generally vertical wellbore 10 shown in elevation. The width of the fracture is generally dependent on the viscosity of the fracturing fluid, and since in embodiments herein the continuous gas phase has a low viscosity, e.g., less than 100 μPa·s, the tip region 16 may have fractures that are too narrow to receive proppant.

Figure 2:
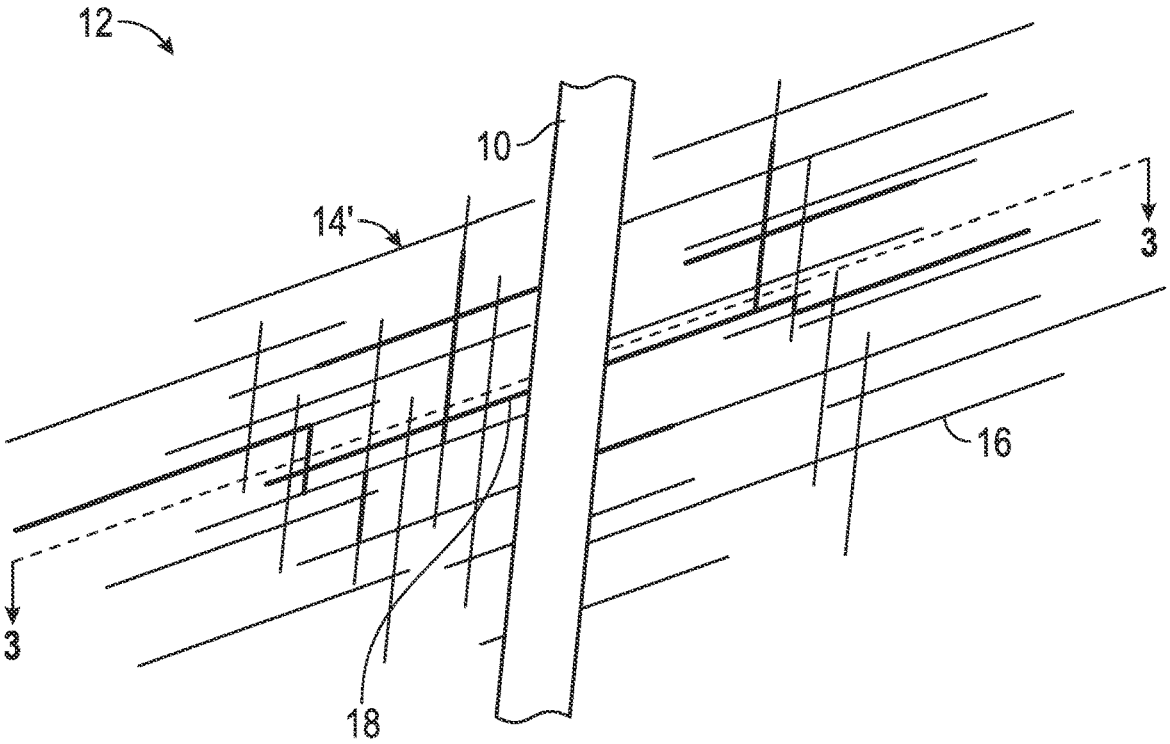
FIG. 2 schematically illustrates the fracture system of FIG. 1 following subsequent injection of one or more proppant stages according to embodiments.

FIG. 2 shows the fracture of FIG. 1 following subsequent injection of one or more proppant stages into the fracture system 14 forming a relatively wide fracture, i.e., one which is capable of receiving a treatment stage containing proppant in the near-wellbore fracture region 18 of the fracture system 14'. In some embodiments, the proppant is placed or formed into clusters according to any of various heterogeneous proppant placement techniques, e.g., by introducing alternating cluster-forming and channel-forming substages, such as, for example, alternating proppant-laden and proppant-lean substages.

Figure 3:
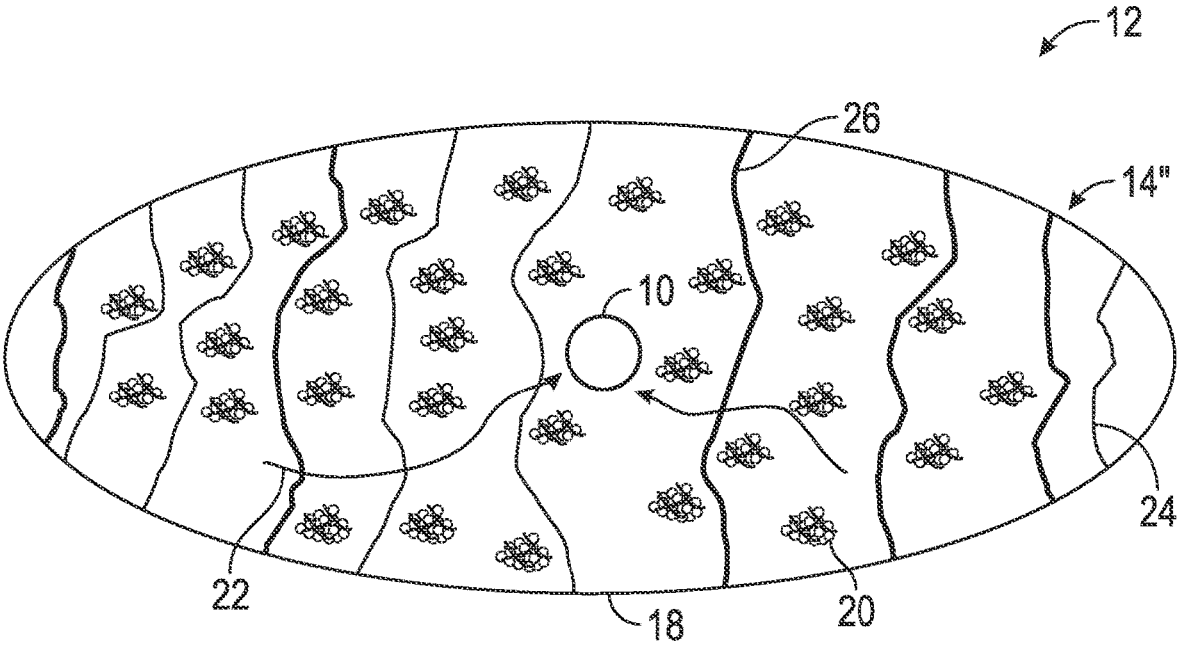
FIG. 3 schematically illustrates a heterogeneously propped region of a hybrid fracture as seen generally along the lines 3-3 of FIG. 2 following formation of proppant pillars and fracture closure according to embodiments.

FIG. 3 schematically illustrates the near-wellbore portion 18 of the fracture system 14' as seen along the lines 3-3 of FIG. 2, following formation of proppant pillars 20 generally corresponding to proppant clusters placed or formed in accordance with a heterogeneous proppant placement technique, and fracture closure, according to some embodiments to form the ultimate fracture system 14". In the fracture system 14" the gas fractured tip region 16 (see FIG. 2) is in fluid communication with the propped fracture region 18 via intersections 24 with gas-fractured regions and/or via intersections 26 with additional propped fracture regions, which may communicate with further regions of the fracture network. Reservoir fluid from the tip region 16 may flow through hydraulically conductive channels 22 around the pillars 20 (and/or through proppant pillars 20 and/or proppant filling the fracture region 18, according to some embodiments where the proppant pillars or other fracture fill mode is permeable).

While the embodiments have been illustrated and described in detail in the drawings and foregoing description, the same is to be considered as illustrative and not restrictive in character, it being understood that only some embodiments have been shown and described and that all changes and modifications that come within the spirit of the embodiments are desired to be protected. It should be understood that while the use of words such as ideally, desirably, preferable, preferably, preferred, more preferred or exemplary utilized in the description above indicate that the feature so described may be more desirable or characteristic, nonetheless may not be necessary and embodiments lacking the same may be contemplated as within the scope of the disclosure, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

We claim:

1. A method for treating a subterranean formation penetrated by a wellbore, comprising:

injecting into a fracture in the formation a gas treatment fluid stage above a fracturing pressure, wherein the gas treatment fluid stage is substantially free of proppant and wherein the gas treatment fluid stage is a mist that comprises a continuous gas phase and a mist phase, wherein the continuous gas phase is present at a concentration above 95 percent by volume, and the mist phase comprises particles in an amount below 5 percent by volume;

depositing the mist phase particles onto a face of a fracture within the formation to inhibit fluid loss into a formation matrix; and reducing the pressure in the fracture to form a network of flow paths in the formation, wherein the mist phase particles are smaller than 100 microns.

2. The method of claim 1, wherein the mist phase comprises a hydrocarbon.

3. The method of claim 1, wherein the mist phase comprises a hydrolyzable compound.

4. The method of claim 1, wherein the mist phase comprises a degradable oil.

5. The method of claim 1, wherein the mist phase comprises a material selected from the group consisting of esters, polyamines, polyethers, and any combination thereof.

6. The method of claim 1, wherein the mist phase comprises a foaming agent.

7. The method of claim 1, wherein the mist phase comprises fine solids.

8. The method of claim 1, comprising degrading the mist phase particles deposited on the formation surface to facilitate conductivity.

9. The method of claim 1, wherein the mist phase comprises mist phase particles at a concentration of at least 0.5 percent and below 5 percent by volume.

10. The method of claim 1, wherein the gas treatment fluid stage is injected as a pad or pre-pad stage and the method further comprises:

injecting one or more proppant stages into the fracture following the gas treatment fluid stage prior to fracture closure.

11. The method of claim 1, comprising:

filling a micropore within the formation with the gas treatment fluid, wherein the gas treatment fluid forms a foam in situ.

12. A gas fracturing system, comprising:

a treatment fluid supply unit configured to inject a treatment fluid stage into a formation, wherein the treatment fluid stage comprises:

a continuous gas phase at a pressure above a fracturing pressure to form a fracture in the formation, wherein the gas phase is present at a concentration higher than 95 percent by volume, and a mist phase that comprises mist phase particles present at a concentration of at least 0.5 percent and below 5 percent by volume, and having a particle size smaller than 100 microns, wherein the mist phase particles are deposited on a fracture face within the formation; and a fluid loss control system present in the mist phase in an amount to inhibit fluid loss into the formation.

13. The gas fracturing system of claim 12, wherein the treatment fluid stage is substantially free of proppant.

14. The gas fracturing system of claim 12, wherein the treatment fluid fills a micropore within the formation, wherein the fluid forms a foam in situ.

15. A method for hydraulic fracturing comprising:

injecting a gas treatment fluid stage in a formation at a treating pressure above a fracturing pressure, wherein the gas treatment fluid is a mist that is substantially free of proppant, and comprises a continuous gas phase at a concentration higher than 95 percent by volume, and a mist phase dispersed in the continuous gas phase as a discontinuous phase in an amount of less than 5 percent by volume;

depositing liquid or foam particles from the mist phase onto a face of a fracture within formation to inhibit fluid loss into a matrix of the formation; and reducing the pressure in the fracture to form a network of conductive gas-fractured flow paths in the formation;

wherein the mist phase particles are smaller than 100 microns.

16. The method of claim 15, wherein the mist phase comprises a foaming agent.

17. The method of claim 15, wherein the mist phase comprises from 0.5 to 5 percent by volume based on the total volume of the gas treatment fluid stage.

18. The method of claim 15, wherein the mist phase further comprises fine solids, and the method further comprises depositing the fine solids onto face of a fracture within the formation.

19. The method of claim 15, comprising:

filling a micropore within the formation with the gas treatment fluid, wherein the gas treatment fluid forms a foam in situ.

* * * * *